United States Patent [19]

Kubo et al.

[11] Patent Number: 4,946,826

[45] Date of Patent: Aug. 7, 1990

[54] THERMAL TRANSFER SHEET COMPRISING AN IMPROVED INK LAYER

[75] Inventors: Naoyuki Kubo; Kiyoshi Senzaki; Yuji Kikuchi; Tsutomu Yashiro, all of Mito, Japan

[73] Assignee: Victor Company of Japan, Ltd., Yokohama, Japan

[21] Appl. No.: 381,348

[22] Filed: Jul. 18, 1989

[30] Foreign Application Priority Data

Jul. 20, 1988 [JP] Japan ..... 63-182148
Nov. 9, 1988 [JP] Japan ..... 63-283161

[51] Int. Cl.[5] ..... B41M 5/035; B41M 5/26

[52] U.S. Cl. ..... 503/227; 8/471; 428/195; 428/412; 428/500; 428/913; 428/914

[58] Field of Search ..... 8/471; 428/195, 412, 428/500, 913, 914; 503/227

[56] References Cited

U.S. PATENT DOCUMENTS 4,873,220 10/1989 Kubodera et al. ..... 503/227
4,886,775 12/1989 Kubodera et al. ..... 503/227

FOREIGN PATENT DOCUMENTS 60-101087 6/1985 Japan ..... 503/227
61-94794 5/1986 Japan ..... 503/227
61-211094 9/1986 Japan ..... 503/227

*Primary Examiner*—Bruce H. Hess
*Attorney, Agent, or Firm*—Lowe, Price, LeBlanc, Becker & Shur

[57] ABSTRACT

A thermal transfer sheet is provided which comprises a support and an ink layer formed on one side of the support. The ink layer is made of a composition of a sublimable dye and a resin binder comprised of not less than 15 parts by weight of an epoxy resin and not less than 30 parts by weight of a butyral resin. The resin binder is effective in suppressing soiling on a sheet to be transferred as will be caused by the dye additionally deposited on the background of the thermal transfer sheet during the thermal printing procedure.

7 Claims, 1 Drawing Sheet

THERMAL TRANSFER SHEET COMPRISING AN IMPROVED INK LAYER

BACKGROUND OF THE INVENTION

1. Field of the Invention

This invention relates to the art of thermal transfer printing and more particularly, to a thermal transfer sheet using thermally sublimable dyes and adapted for use in full color hard copies obtained by printing apparatus of the thermally sublimable dye transfer type.

2. Description of the Prior Art

In recent years, a variety of color image or picture reproducing apparatus such as home video tape recorders, computer graphic systems and the like have been widely spread, so that apparatus for outputting reproduction image information have been expected. As such an outputting apparatus, there have now been developed printing apparatus including ink jet systems, electrophotographic systems and thermal transfer systems. Among these printers, the printer of the thermal transfer type is advantageous in that it has a simple mechanism with ease in handling, that noises during the printing are not so high, and that the resultant full color images have good gradation properties.

The printers of the thermal transfer type can be broadly divided into two classes. One class makes use of thermally sublimable dyes as a colorant and the other class makes use of a hot melt comprised of a thermally fusible binder and a pigment as a colorant. The fundamental printing procedure using these printer systems is as follows. A thermal transfer sheet having a substrate provided with an ink layer on one side thereof and a sheet to be transferred are superposed so that the ink layer is facing to the sheet to be transferred. The superposed sheets are heated in accordance with information signals with a thermal head of the printer, for example, from the side of the thermal transfer sheet. As a result, the colorant in the ink layer of the thermal transfer sheet is transferred to the sheet to be transferred in an imagewise pattern.

When comparing the thermal transfer systems of the sublimation type and the hot melt type, it is generally accepted that the the sublimation-type system is poorer in dyeing density and storage stability of the thermal transfer sheet than the hot melt-type system. However, the sublimation-type system exhibits higher resolving power than the hot melt-type system with printed images of higher quality being obtained. Recent developments of sublimation-type printer tend to make the best use of the above advantage. In particular, since the density of picture elements of the thermal head increases, a further tendency toward high-quality printing is shown.

However, for obtaining clear printed images with high density by the sublimation-type thermal transfer system, it is necessary that a sublimable dye be contained in the ink layer of the thermal transfer sheet at a relatively high ratio to binder. When such a thermal transfer sheet is used for printing, a soiling-on-background phenomenon where an additional dye undergoes color development in portions other than those where images are to be formed will occur with a passage of storage time for the sheet. This will cause a lowering in quality of the printed image.

SUMMARY OF THE INVENTION

It is accordingly an object of the invention to provide an improved thermal transfer sheet adapted for use in a thermal transfer printing system wherein a sublimable dye is sublimated in an imagewise pattern by application of heat from a thermal head from an ink layer of the thermal transfer sheet to a sheet to be transferred whereby clear images with high density can be obtained while suppressing the soiling phenomenon over a long term.

It is another object of the invention to provide a thermal transfer sheet which ensures clear printed images with high quality formed on sheets to be transferred.

The above objects can be achieved, according to the invention, by a thermal transfer sheet which comprises a support and an ink layer formed on the support and made of a composition of a dye capable of sublimation by application of heat and a resin mixture comprised of an epoxy resin and a butyral resin. The resin mixture comprises not less than 15 parts by weight of an epoxy resin and not less than 30 parts by weight of a butyral resin provided that the total amount of the epoxy resin and the butyral resin is 100 parts by weight. When this resin mixture is used in combination with a relative high content of sublimable dyes as ordinarily used for this purpose, the soiling on background is suppressed to a substantial extent. The mixing ratio between the resin mixture and the sublimable dye is preferably in the range of from 1:3 to 5:1 on the weight basis.

DETAILED DESCRIPTION AND EMBODIMENTS OF THE INVENTION

Figure 1:
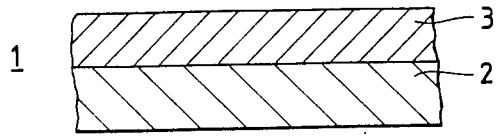
FIG. 1 is a schematic sectional enlarged view of part of a thermal transfer sheet according to the invention.
Figure 2:
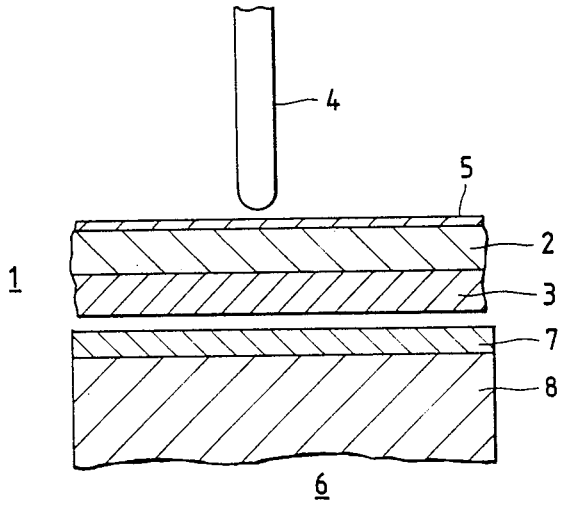
FIG. 2 is a schematic sectional enlarged view of part of a thermal transfer sheet and a sheet to be transferred for illustration of printing operations using a thermal printing head.

Reference is now made to the accompanying drawings wherein like reference numerals indicate like parts or members. In FIG. 1, there is indicated a thermal transfer sheet generally indicated as 1. The sheet 1 includes a substrate 2 and an ink layer 3 formed on the substrate 2. In FIG. 2, the thermal transfer sheet 1 is in face-to-face relation with a sheet 6 to be transferred which includes an image-receiving layer 7 formed on a substrate 8. In this case, the thermal transfer sheet 1 has a lubricating, heat-resistant layer 5 which is provided at a side where a thermal printing head 4 is provided.

In operation, heat from the thermal printing head 4 is applied according to information signals through the substrate 2 to the ink layer 3 of the thermal transfer sheet 1. By this, the sublimable dye in the ink layer 3 is sublimated in an imagewise pattern and deposited on the image-receiving layer 7 to obtain a printed image.

The substrate 2 of the sheet 1 may be any known plastic film or condenser paper. The plastic films are favorably made of heat-resistant resins such as polyethylene terephthalate, polyimides, polyacrylates, polyether imides, polysulfones and the like. A smaller thickness of the substrate results in better sensitivity, thus leading to better resolving powder and better response to heat from the thermal head. In view of the heat resistance and the ease in handling during a fabrication process, the thickness is generally in the range of from 2 to 100 micrometers, preferably from 3 to 20 micrometers.

The ink layer 3 formed on one side of the substrate 1 is made of a sublimable dye and a binder. The sublimable dyes include azo dyes, anthraquinone dyes, nitro dyes, quinophthalone dyes, styryl dyes, thiazole dyes, naphthoquinone dyes and the like, of which suitable dyes should be selected in view of the compatibility with binder, sublimability and light fastness. Preferable dyes are azo dyes, anthraquinone dyes and the like.

The binder used in the present invention is made of a mixture of an epoxy resin and butyral resin.

In prior art thermal transfer sheets, the binder selected is a resin which has not great affinity for sublimable dye, does not prevent sublimation of sublimable dye, and has an appropriate degree of heat resistance so that when heated with the thermal head 4, the sticking between the ink layer 3 and the image-receiving layer 7 does not occur. For example, linear saturated polyester resins, epoxy resins, styrene resins, butyral resins and methyl methacrylate resins are used singly or in combination with cellulosic resins such as ethyl cellulose resin, methyl cellulose resin, cellulose acetate/propionate resins and the like. When these resins are used singly as the binder for the ink layer, coagulation of the sublimable dye used has, in most cases, took place as storage time passes. In printed images which are obtained from the thermal transfer sheet having coagulation of the dye in the ink layer, so-called soiling-on-background takes place in which color development owing to the pressing of the thermal head appears on portions other than those where images are to be formed.

This is effectively suppressed when using the binder which is a mixture of an epoxy resin and a butyral resin. The epoxy resin useful in the present invention may be any type of epoxy resin and is preferably a typical epoxy resin obtained from bisphenol A and epichlorohydrin or the like. The epoxy resin should preferably have a number average molecular weight not smaller than 10,000, more preferably not smaller than 50,000, in view of the good storage life.

The butyral resin useful in the present invention should preferably have a number average molecular weight of not smaller than 50,000.

The resin mixture should be comprised of not less than 15 parts by weight, preferably from 20 to 70 parts by weight, of an epoxy resin and not less than 30 parts by weight, preferably from 30 to 80 parts by weight, of a butyral resin in a total amount of 100 parts by weight. If the content of epoxy resin is less than 20 parts by weight, the storage stability or life becomes slightly poor. This tendency becomes pronounced when the content is less than 15 parts by weight. On the other hand, over 70 parts by weight, the sticking problem owing to the thermal fusion of the ink layer 3 to the image-receiving layer 7 is liable to occur.

If desired, other resins such as cellulosic resins as mentioned before with reference to the prior art and polyesters and the like may be added to the mixture in amounts not impeding the effect of the mixture, i.e. in amounts of up to 10 wt% based on the epoxy and butyral resin mixture.

Moreover, known additives or fillers such as antistatic agents, UV absorbers and calcium carbonate may be added to the ink layer composition, if necessary.

As mentioned before, the thermal transfer sheet of the invention may further comprise the lubricating heat-resistant layer 5 on the side opposite to the side having the ink layer 3 in order to prevent sticking between the ink layer 3 and the image-receiving layer 7 and to facilitate the runnability of the thermal head 4. This layer 5 is made, for example, of silicone resins, fluorocarbon resins and the like.

The thermal transfer sheet 1 of the invention is fabricated in the following manner. A sublimable dye and a binder are dissolved in a solvent for the binder such as toluene, methyl ethyl ketone, cyclohexanone or the like used singly or in combination, thereby obtaining an ink composition. The ink composition is coated on a substrate by known coating techniques such as bar coating, gravure coating, blade coating and the like and dried to obtain a thermal transfer sheet.

The present invention is more particularly described by way of examples. Comparative examples are also shown. In these examples and comparative examples, parts are by weight.

EXAMPLE 1

An ink layer composition of the following formulation was prepared.

| | | |
|---|---|---|
| (1) | Sublimable dye (PTB-16, available from Mitsubishi Chem. Ind. Co. Ltd.) | 6.2 parts |
| (2) | Epoxy resin (Epikote 1255-Hx-30, available from Yuka Shell Epoxy Co., Ltd.) | 0.75 parts |
| (3) | Butyral resin (BX-5, available from Sekisui Chem. Co., Ltd.) | 4.25 parts |
| (4) | Toluene | 40.0 parts |
| (5) | Methyl ethyl ketone | 38.8 parts |
| (6) | Cyclohexanone | 10.0 parts |

The ink layer composition was applied onto one side of a 6 μm thick polyethylene terephthalate film having a lubricating heat-resistant silicone resin layer on the other side by means of a gravure coater, followed by drying with hot air to obtain a thermal transfer sheet of the invention.

A sheet to be transferred was obtained by coating an image-receiving layer composition of a linear saturated polyester resin on an art paper substrate by means of a doctor blade and dried.

The thus obtained thermal transfer sheet and sheet to be transferred were superposed so that the ink layer and the image-receiving layer were facing each other. In this state, the sheets were subjected to printing by the use of a sublimation-type thermal transfer printer having a thermal head whose heating resistor density was 8 dots/mm. Moreover, the thermal transfer sheet was allowed to stand in an atmosphere of 60° C. and 60% R.H. for 24 hours, followed by printing to check the presence or absence of soiling. The results are shown in Table 1.

EXAMPLE 2

The general procedure of Example 1 was repeated except that the epoxy resin (Epikote 1255-HX-30) was changed in amount from 0.75 parts to 1 part and the butyral resin (BX-5) was reduced from 4.25 parts to 4 parts, thereby obtaining a thermal transfer sheet. The sheet was similarly tested with the results shown in Table 1. It will be noted that the results of the following examples and comparative examples are also shown in Table 1.

EXAMPLE 3

The general procedure of Example 1 was repeated except that the amount of the epoxy resin (Epikote 1255-HX-30) was increased to 2.5 parts and the amount of the butyral resin (BX-5) was decreased to 2.5 parts, thereby obtaining a thermal transfer sheet.

EXAMPLE 4

The general procedure of Example 1 was repeated except that the amount of the epoxy resin (Epikote 1255-HX-30) was increased to 3.5 parts and the amount of the butyral resin (BX-5) was decreased to 1.5 parts, thereby obtaining a thermal transfer sheet.

COMPARATIVE EXAMPLE 1

The general procedure of Example 1 was repeated except that the amount of the epoxy resin (Epikote 1255-HX-30) was increased to 5 parts and the butyral resin (BX-5) was not used, thereby obtaining a thermal transfer sheet.

COMPARATIVE EXAMPLE 2

The general procedure of Example 1 was repeated except that the epoxy resin (Epikote 1255-HX-30) was not used and the amount of the butyral resin (BX-5) was increased to 5 parts, thereby obtaining a thermal transfer sheet.

COMPARATIVE EXAMPLE 3

The general procedure of Example 3 was repeated except that the butyral resin (BX-5) was replaced by ethyl cellulose (N-7, available from Hercules Inc.), thereby obtaining a thermal transfer sheet.

COMPARATIVE EXAMPLE 4

The general procedure of Example 3 was repeated except that the butyral resin (BX-5) was replaced by linear saturated polyester resin (Biron 200, available from Toyobo Co., Ltd.), thereby obtaining a thermal transfer sheet.

COMPARATIVE EXAMPLE 5

The general procedure of Example 3 was repeated except that the epoxy resin (Epikote 1255-HX-30) was replaced by ethyl cellulose (N-7, available from Hercules Inc.), thereby obtaining a thermal transfer sheet.

COMPARATIVE EXAMPLE 6

The general procedure of Example 3 was repeated except that the epoxy resin (Epikote 1255-HX-30) was replaced by linear saturated polyester resin (Biron 200, available from Toyobo Ltd.), thereby obtaining a thermal transfer sheet.

TABLE 1

| Sample | Content of Epoxy Resin | Content of Butyral Resin | Print Density | Soiling | Sticking |
|---|---|---|---|---|---|
| Example 1 | 15 parts | 85 parts | 1.65 | Δ | ○ |
| Example 2 | 20 parts | 80 parts | 1.66 | ○ | ○ |
| Example 3 | 50 parts | 50 parts | 1.71 | ○ | ○ |
| Example 4 | 70 parts | 30 parts | 1.76 | ◎ | ○ |
| Comp. Ex. 1 | 100 parts | 0 part | 1.82 | Δ | Δ |
| Comp. Ex. 2 | 0 | 100 parts | 1.63 | X | ○ |
| Comp. Ex. 3 | 50 parts | 0 part | 1.70 | X | ○ |
| Comp. Ex. 4 | 50 parts | 0 part | 1.59 | X | X |
| Comp. Ex. 5 | 0 part | 50 parts | 1.64 | X | ○ |
| Comp. Ex. 6 | 0 part | 50 parts | 1.52 | X | X |

In Table 1, the print density was measured by the use of the Macbeth reflection densitometer RD-918.

The thermal transfer sheets of the invention exhibit high print densities. A higher content of the epoxy resin tends toward a higher density with a clearer image.

The soiling was evaluated in the following manner: ○ is the case where a good print image was obtained without any soiling; Δ indicates the case where a slight degree of soiling was observed; and X indicates the case where a substantial degree of soiling was observed. The thermal transfer sheets for comparison are not good with respect to the soiling and the binders used are considered inappropriate.

The sticking was evaluated as follows: ○ indicates no sticking, Δ indicates a slight degree of sticking with a sheet to be transferred; and X indicates a substantial degree of sticking.

As will be apparent from the above table, the thermal transfer sheets of the invention exhibit good results for all the tests. Better results are obtained when the content of the epoxy resin is in the range of from 20 to 70 parts by weight.

In the following examples, the number average molecular weight of epoxy resin was changed using Epikote 1255 having a number average molecular weight of 50,000, Epikote 1100L having a number average molecular weight of 12,000, Epikote 1010 having a number average molecular weight of 5,000 and Epikote 1007 having a number average molecular weight of 2,000.

EXAMPLES 5 TO 7

The thermal transfer sheet of Example 4 using Epikote 1255 was provided as a sample.

The general procedure of Example 4 was repeated except that Epikote 1255 was replaced by Epikote 1100L, 1010 and 1007, thereby obtaining thermal transfer sheets.

These sheets were tested in the same manner as in Example 1 with the results shown in Table 2 below.

TABLE 2

| Sample | Number Average Molecular Weight of Epoxy Resin | Print Density | Soiling | Sticking |
|---|---|---|---|---|
| Example 4 | 50,000 | 1.76 | ◎ | ○ |
| Example 5 | 12,000 | 1.85 | ○ | ○ |
| Example 6 | 5,000 | 1.86 | Δ | ○ |
| Example 7 | 2,000 | 1.89 | Δ | ○ |

The evaluations of the soiling and sticking were made similar to those of the foregoing examples. As will be apparent from the above table, better results with respect to the soiling are obtained for a higher molecular weight.

What is claimed is:

1. A thermal transfer sheet which comprises a support and an ink layer formed on the support and made of a composition of a dye capable of sublimation by application of heat and a resin mixture comprised of not less than 15 parts by weight of an epoxy resin and not less than 30 parts by weight of a butyral resin provided that the total amount of the epoxy resin and the butyral resin is 100 parts by weight.

2. The thermal transfer sheet according to claim 1, wherein said resin mixture consists essentially of the epoxy resin and the butyral resin.

3. The thermal transfer sheet according to claim 2, wherein said epoxy resin is contained in an amount of from 20 to 70 parts by weight with the balance of the butyral resin.

4. The thermal transfer sheet according to claim 1, wherein said epoxy resin has an average molecular weight of not less than 10,000.

5. The thermal transfer sheet according to claim 4, wherein said epoxy resin has an average molecular weight of not less than 50,000.

6. The thermal transfer sheet according to claim 1, wherein said dye and said resin mixture are used at a ratio by weight of 3:1 to 1:5.

7. The thermal transfer sheet according to claim 1, further comprising a lubricating, heat-resistant layer formed on a side opposite to the ink layer side of the support.

* * * * *